US011998106B2

(12) United States Patent
Goto et al.

(10) Patent No.: US 11,998,106 B2
(45) Date of Patent: Jun. 4, 2024

(54) PORTABLE TOOL BRACKET AND PORTABLE TOOL

(71) Applicant: TJM DESIGN CORPORATION, Tokyo (JP)

(72) Inventors: Akio Goto, Tokyo (JP); Akihito Sato, Tokyo (JP); Nobuko Tayama, Tokyo (JP)

(73) Assignee: TJM DESIGN CORPORATION, Tokyo (JP)

( * ) Notice: Subject to any disclaimer, the term of this patent is extended or adjusted under 35 U.S.C. 154(b) by 0 days.

(21) Appl. No.: 17/807,176

(22) Filed: Jun. 16, 2022

(65) Prior Publication Data

US 2022/0400839 A1 Dec. 22, 2022

(30) Foreign Application Priority Data

Jun. 18, 2021 (JP) ..... 2021-101980

(51) Int. Cl.
*A45F 5/00* (2006.01)

(52) U.S. Cl.
CPC ..... *A45F 5/00* (2013.01); *A45F 2200/0575* (2013.01)

(58) Field of Classification Search
CPC .... A45F 5/00; A45F 5/021; A45F 2200/0575; Y10S 224/904
See application file for complete search history.

(56) References Cited

U.S. PATENT DOCUMENTS 6,824,028 B2 * 11/2004 Mutai ..... A45F 5/02 224/904
6,848,605 B2 * 2/2005 Dillenberger ..... B25H 3/006 224/904
6,905,051 B2 * 6/2005 Chee ..... A45F 5/00 224/665
7,216,788 B2 * 5/2007 Blechman ..... B25H 3/006 224/269
7,261,264 B2 * 8/2007 Moran ..... A01K 5/0114 248/221.11
7,354,304 B2 * 4/2008 Livingston ..... A45F 5/02 439/501
7,665,684 B2 * 2/2010 Salentine ..... A45F 5/021 242/379.2
7,726,706 B2 * 6/2010 Moran ..... G09F 17/00 292/341.15
9,173,475 B2 * 11/2015 Blechman ..... A45F 5/02
9,808,074 B2 * 11/2017 Kinskey ..... A45F 5/021
9,844,257 B2 * 12/2017 Kinskey ..... A45F 5/021
(Continued)

FOREIGN PATENT DOCUMENTS

JP 4172929 B2 10/2008

*Primary Examiner* — Robert Sandy
*Assistant Examiner* — Louis A Mercado
(74) *Attorney, Agent, or Firm* — KENJA IP LAW PC

(57) ABSTRACT

A portable tool bracket 20 has a hook member 25 having a mounting portion 21 attached to a portable tool body 10 and a notch portion 24 for hooking and holding, an insertion portion 22 that is inserted into a guide rail portion 31 provided to a holder 30 attached to a waist belt 2 and is detachably attached to the holder 30. The insertion portion 22 has a pair of overhang portions that overhang on both sides of the insertion portion 22 with respect to the hook member 25.

2 Claims, 13 Drawing Sheets

(56) References Cited

U.S. PATENT DOCUMENTS

2003/0164389 A1* 9/2003 Byers ..... A45F 5/00
224/221
2008/0283563 A1* 11/2008 O'Donnell ..... A45F 5/02
224/269

* cited by examiner

PORTABLE TOOL BRACKET AND PORTABLE TOOL

TECHNICAL FIELD

The present invention relates to a portable tool bracket configured to hold a portable tool in a holder held by a body of a user and a portable tool with the portable tool bracket attached.

BACKGROUND

As tools (hereinafter referred to as "portable tools") such as measuring tapes, flashlights, water bottles, small electronic devices (e.g. cellular phones, smartphones, tablets, electronic calipers) or the like carried by workers at building sites, construction sites, etc., for example, those to which a portable tool bracket provided with an insertion portion is attached have been known, the insertion portion being detachably attached to a holder that is attached to a waist belt, or the like, and held by a body of a worker. (see, for example, Patent Literature (PTL) 1).

Such a portable tool is held in a holder by inserting an insertion portion into the guide rail portion provided in the holder to lock, and can be carried in a state where the tool is prevented from falling. Further, when the locking of the insertion portion by the holder is released, the portable tool can be easily detached from the holder and used.

CITATION LIST

Patent Literature

PTL 1: JP4172929 (B2)

SUMMARY

Unfortunately, the above-described existing portable tool has a shape in which the insertion portion of the portable tool bracket can be attached only to a dedicated holder. Thus, in order for a worker to attach the portable tool to a waist belt or the like to carry it, a dedicated holder should always be attached to the waist belt or the like, and if the worker does not have a dedicated holder, it is difficult for the worker to carry the portable tool.

In view of the foregoing circumstances, it is an object of the present invention to provide: a portable tool bracket that allows the portable tool to be carried while preventing it from falling and to be carried by attaching it to an article to be hooked such as a waist belt even if a dedicated holder is not provided; and a portable tool provided with the portable tool bracket.

The portable tool bracket according to the present invention has a mounting portion attached to a portable tool body, an insertion portion that is inserted into a guide rail portion provided on a holder held by a body of a user and is detachably attached to the holder, and a notch portion for hooking and holding.

In the portable tool bracket according to the present invention, it is desirable that the notch portion has, in the above-described configuration, an open end on one side of the center of gravity of the portable tool body and on the side of the center of gravity of an end of the one side of the portable tool body, and an innermost portion on the other side of the center of gravity of the portable tool body.

In the portable tool bracket according to the present invention, it is desirable that, in the above-described configuration, the notch portion is provided between the mounting portion and the insertion portion.

In the present invention, a notch portion for hooking and holding is provided to the portable tool bracket provided with an insertion portion. Thus, when a dedicated holder is provided, the insertion portion is attached to the holder so that the portable tool can be carried while preventing it from falling. Further, even if a dedicated holder is not provided, a portable tool can be carried by hooking the portable tool bracket on an article to be hooked such as a waist belt or a pocket.

Therefore, according to the present invention, a portable tool bracket that allows a portable tool to be carried while preventing the portable tool from falling, and even when a dedicated holder is not provided, allows the portable tool to be carried by attaching the portable tool to an article to be hooked such as a waist belt, or the like, and a portable tool provided with the portable tool bracket can be provided.

DETAILED DESCRIPTION

An embodiment of the present invention will be illustrated below with reference to the drawings.

Figure 1:
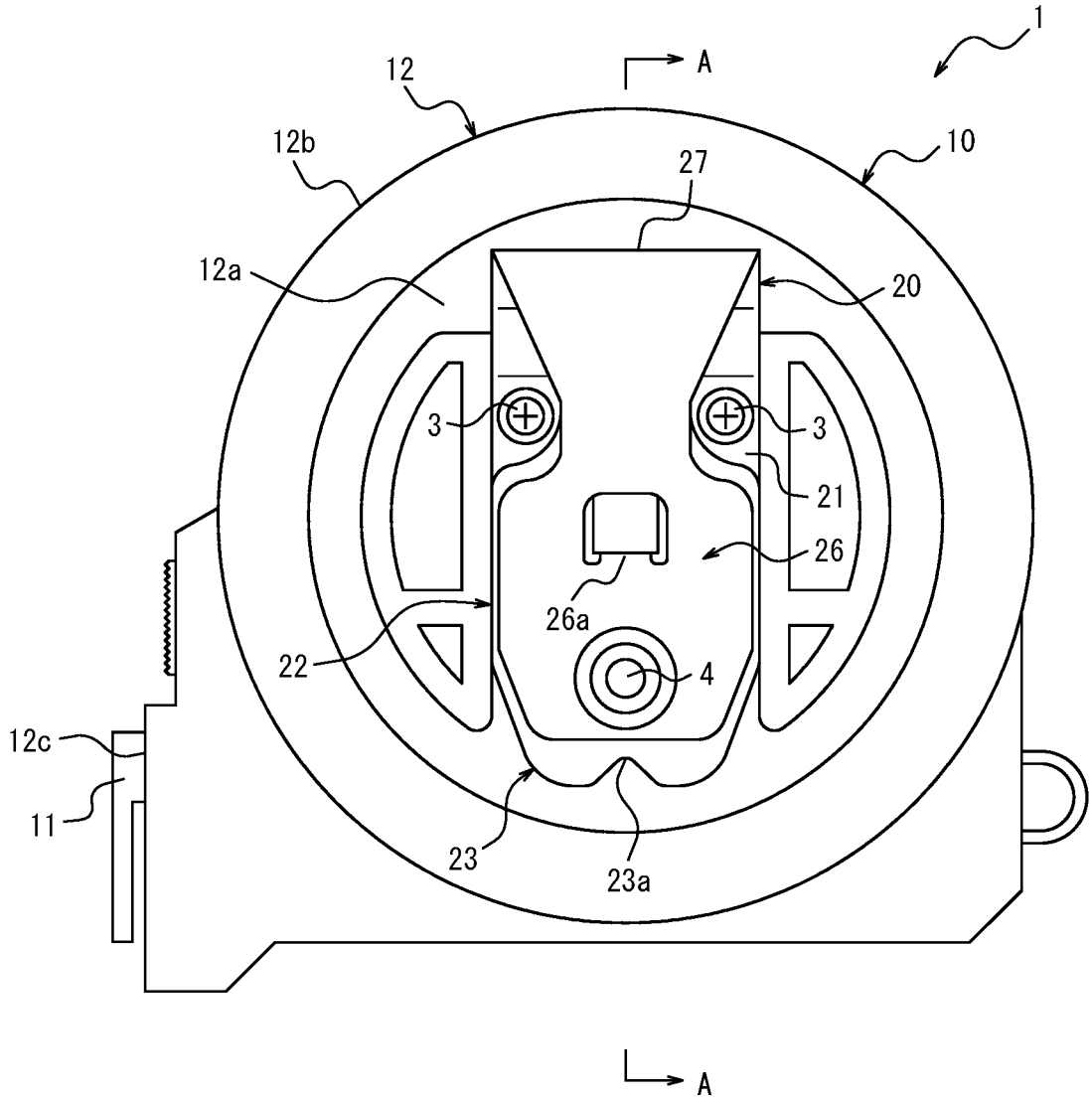
FIG. 1 is a front view of a portable tool according to an embodiment of the present invention.
Figure 2:
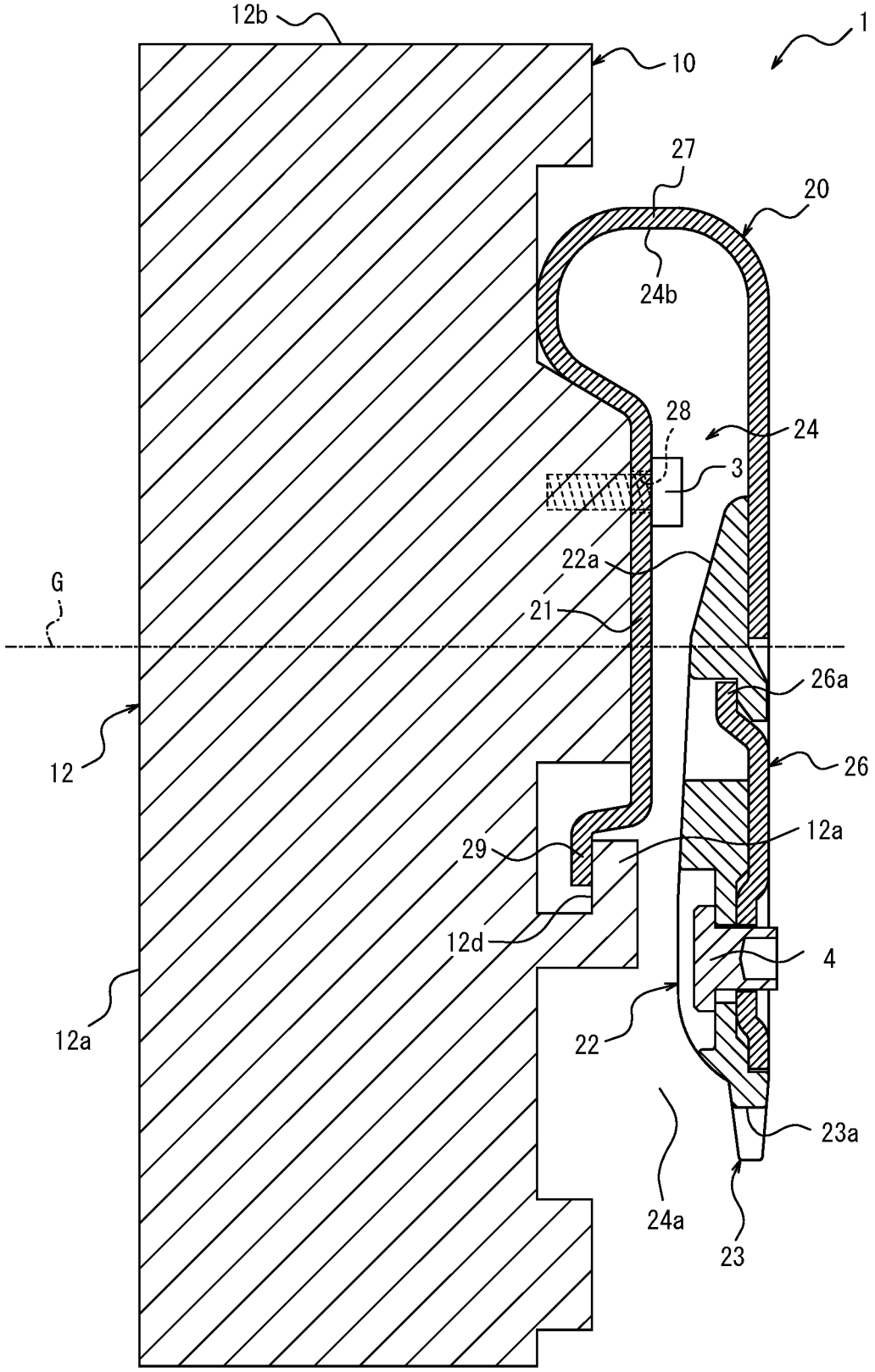
FIG. 2 is a cross-sectional view of the portable tool illustrated in FIG. 1 along the line A-A (the cross-section of the portable tool body is not illustrated)

As illustrated in FIGS. 1 and 2, a portable tool 1 according to an embodiment of the present invention has a portable tool body 10 and a portable tool bracket 20 attached to the portable tool body 10.

The portable tool body 10 may be a tool such as a measuring tape, a flashlight, a water bottle, a small electronic device (e.g. a cellular phone, a smartphone) or the like carried by workers at building sites or construction sites, or the like. In this embodiment, the portable tool body 10 is a measuring tape.

The portable tool body 10, which is a measuring tape, has a case body 12 that rolls up and stores a steel tape 11 constituting a ruler. The case body 12 has a pair of substantially circular side walls 12*a* centered on a rolled-up axis of the steel tape 11 and a cylindrical peripheral wall 12*b* connecting these side walls. Further, the case body 12 has a drawer port 12*c* for the steel tape 11 at the lower end side thereof.

The portable tool bracket 20 has a mounting portion 21. The portable tool bracket 20 is attached to one of the side walls 12*a* of the case body 12 of the portable tool body 10 at the mounting portion 21.

The portable tool bracket 20 has an insertion portion 22. The insertion portion 22 is inserted into a guide rail portion 31 provided to a dedicated holder 30 (see FIG. 4) held by a body of a user and is detachably attached to the holder 30.

Figure 3:
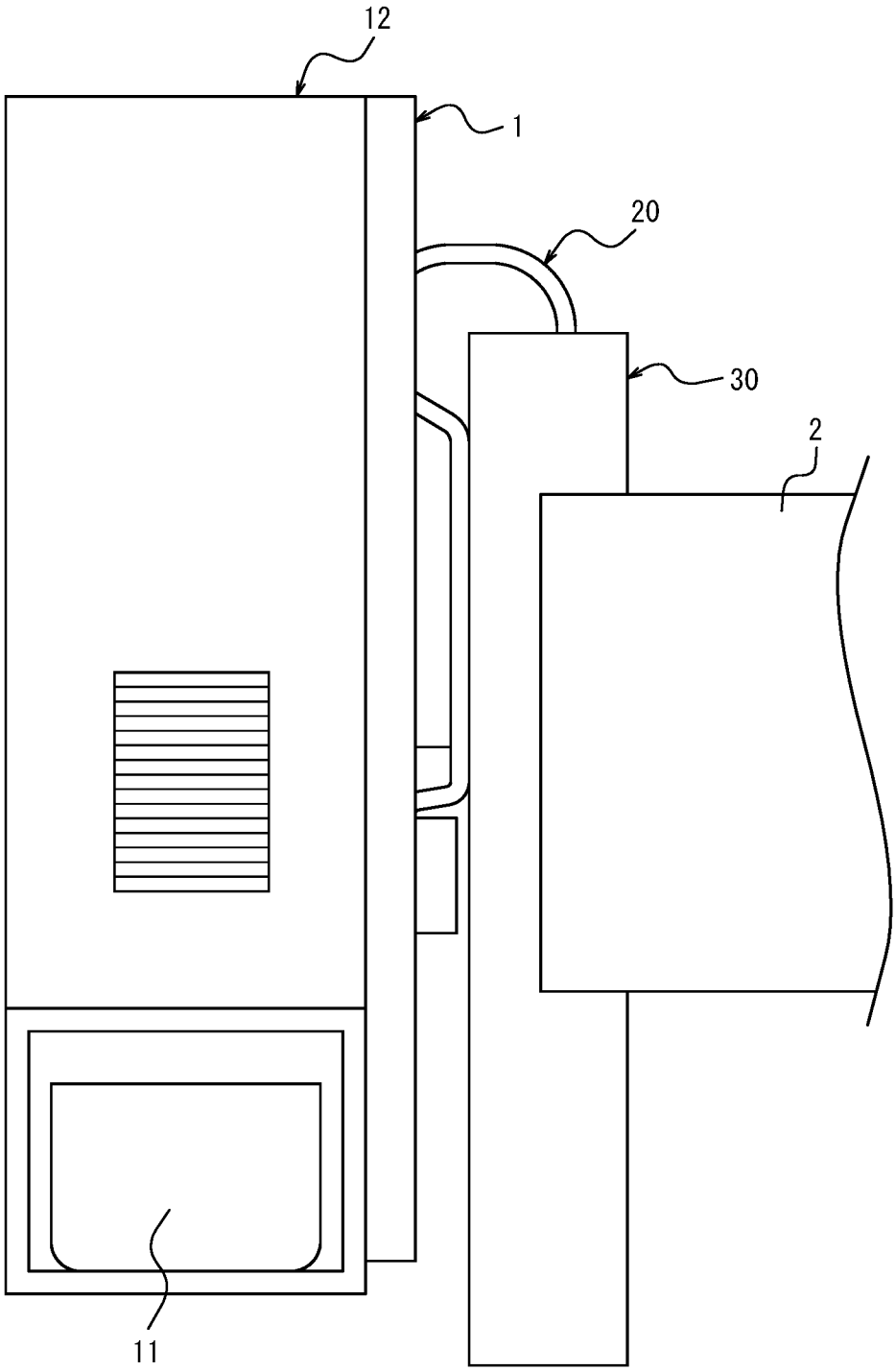
FIG. 3 is a diagram illustrating a state in which a portable tool bracket is attached to a holder to carry the portable tool.

A user (a worker) of the portable tool 1 attaches the insertion portion 22 of the portable tool bracket 20 to the dedicated holder 30 so that the portable tool 1 is held by the holder 30, as illustrated in FIG. 3, and can carry the portable tool 1 while preventing it from falling.

More specifically, the insertion portion 22 has a substantially rectangular shape having a constant width when viewed from the front as illustrated in FIG. 1, and both sides thereof project into a plate shape. The insertion portion 22 may also be configured such that a tapered guide portion 23 is integrally provided on the end side in the direction of insertion into the holder 30.

Figure 4:
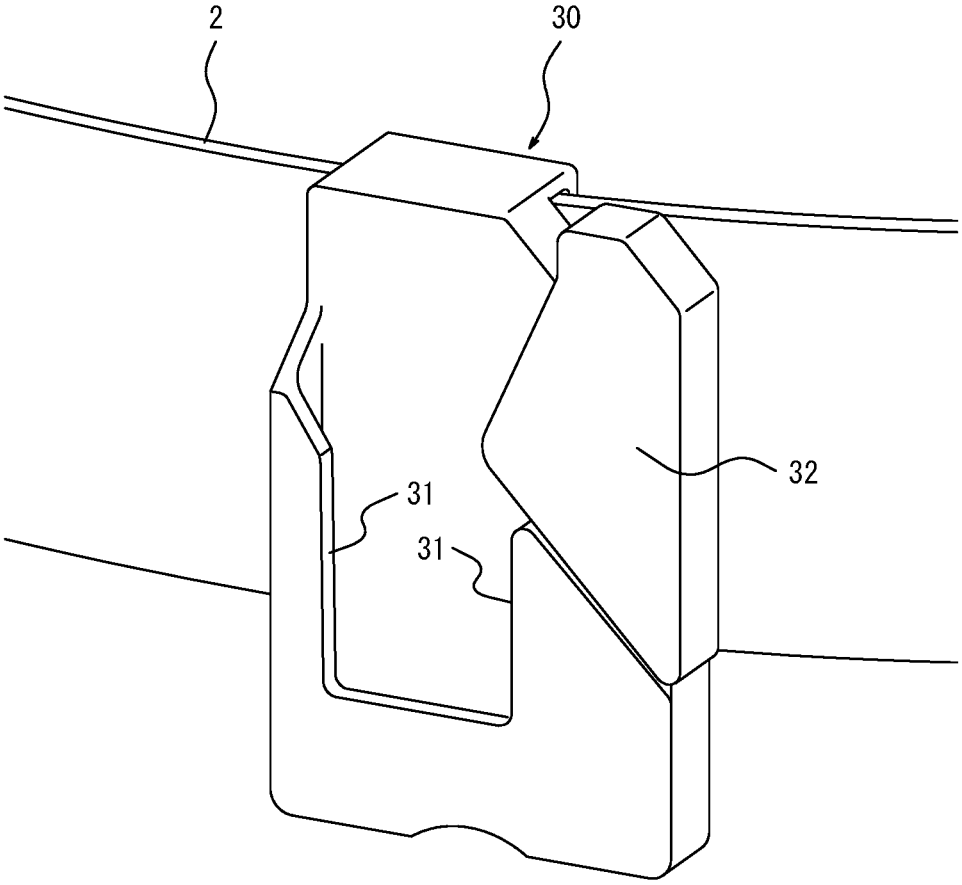
FIG. 4 is a perspective view illustrating the holder attached to a waist belt.

As illustrated in FIG. 4, the holder 30 can be configured to be attached, for example, to the waist belt 2 and held by a body of a user. The holder 30 is provided with a pair of guide rail portions 31 arranged so as to face each other at a predetermined interval on the front surface side thereof. An upper opening space through which the insertion portion 22 is inserted is compartmentally formed between the pair of guide rail portions 31 and the main body portion of the holder 30. Above the pair of guide rail portions 31 is provided with a locking stopper 32 that can slide diagonally downward.

Figure 5:
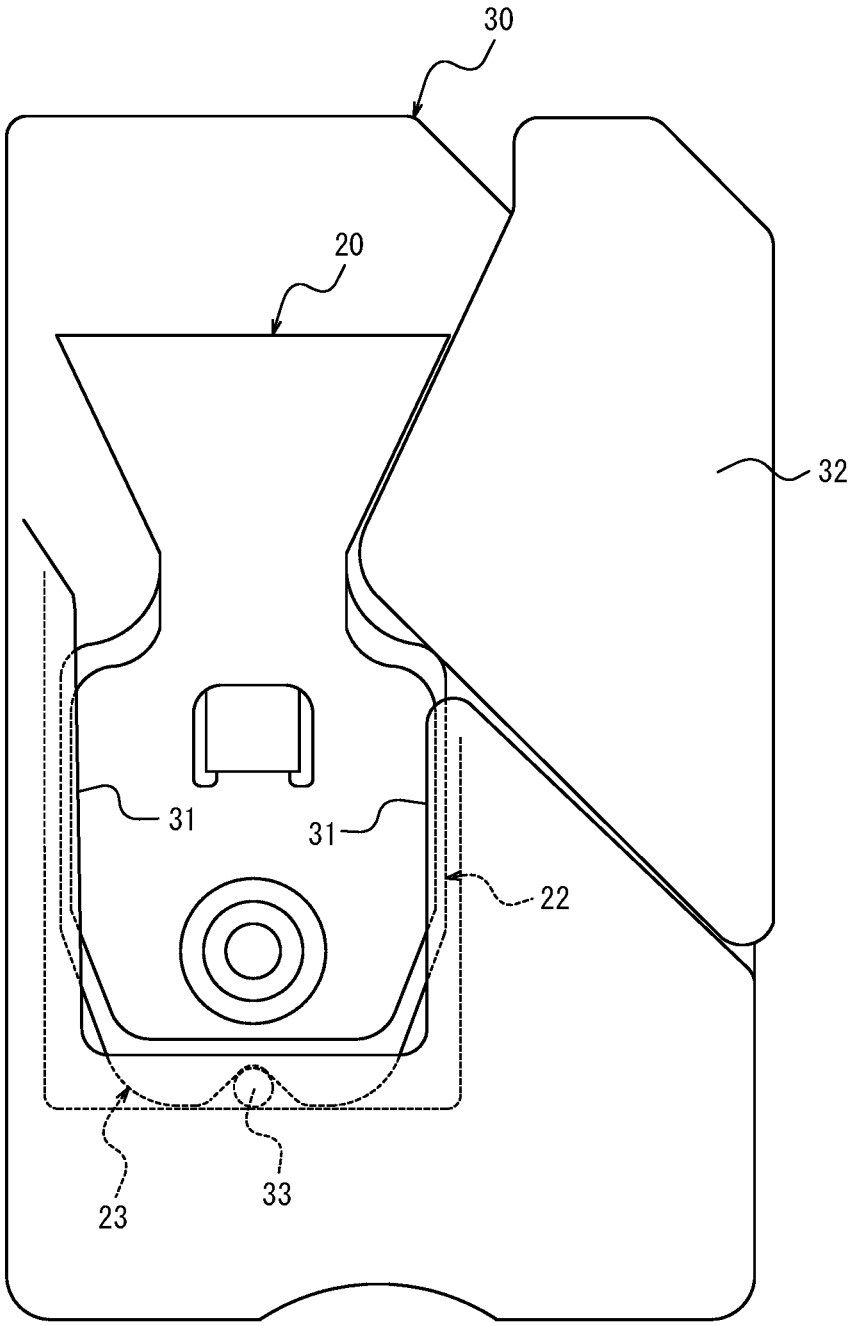
FIG. 5 is a diagram illustrating the holder in a state in which the portable tool bracket is attached.

As illustrated in FIG. 5, the insertion portion 22 of the portable tool bracket 20 is inserted from above between the pair of guide rail portions 31 from the side of the guide portion 23. At this time, a tapered guide portion 23 is integrally provided on the end side of the insertion portion 22 in the insertion direction, which allows a user to easily insert the insertion portion 22 between the pair of guide rail portions 31.

In the insertion portion 22 inserted between the pair of guide rail portions 31, the plate like projections on both sides thereof are held by the pair of guide rail portions 31, and the upper end thereof is locked from above by the locking stopper 32. As a result, the portable tool bracket 20 is attached in a state being retained by the holder 30 at the insertion portion 22.

The locking stopper 32 includes therein an urging member (not illustrated) such as a spring or the like, and may be configured such that it moves diagonally downward against the urging member when the insertion portion 22 is inserted and, after the insertion portion 22 is inserted between the pair of guide rail portions 31, automatically restores to a position where the upper end of the insertion portion 22 is locked.

Further, the portable tool bracket 20 has a recess 23*a* at the end of the guide portion 23, and can be configured such that, when the insertion portion 22 is inserted between the pair of guide rail portions 31 and locked by the locking stopper 32, the pin member 33 provided in the holder 30 engages with the recess 23*a* and the insertion portion 22 is held at a predetermined position.

Figure 6:
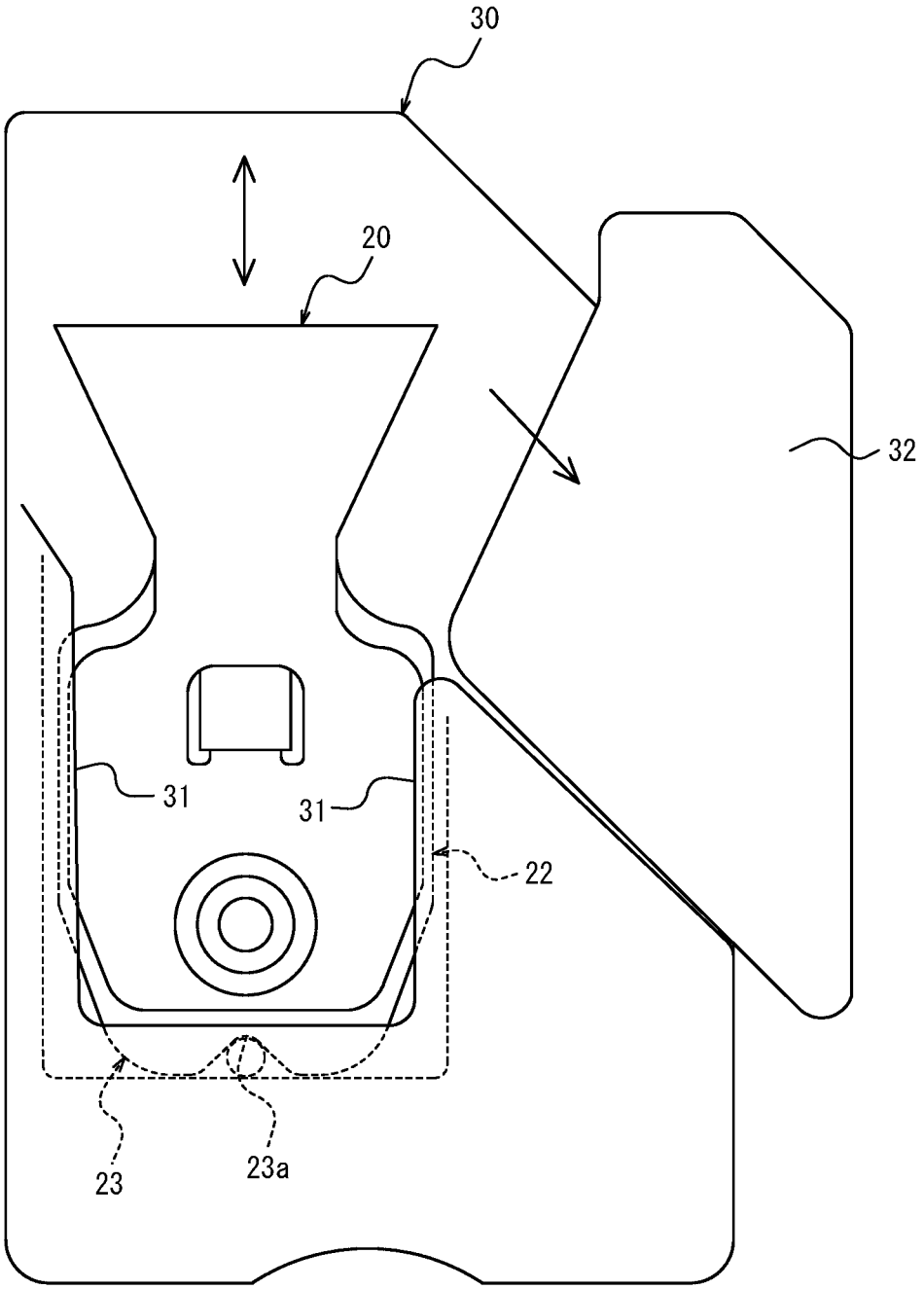
FIG. 6 is a diagram illustrating the holder in a state in which locking of the portable tool bracket is released.

As illustrated in FIG. 6, when the locking stopper 32 is slid diagonally downward with the insertion portion 22 inserted between the pair of guide rail portions 31, the lock of the insertion portion 22 by the locking stopper 32 is released, which allows the insertion portion 22 or the portable tool bracket 20 to be separated from the holder 30, and the portable tool 1 can be removed from the holder 30.

As illustrated in FIG. 2, the portable tool bracket 20 has a notch portion 24 for hooking and holding, in addition to the mounting portion 21 and the insertion portion 22 described above. In FIG. 1, the notch portion 24 has a groove shape that opens downward and on both the left and right sides of the portable tool bracket 20 and extends from the lower side to the upper side along the direction parallel to the side wall 12*a*, then can be hooked on an article to be hooked such as a waist belt 2, a pocket, a band-shaped object, a ring, a string, or the like.

The vertical length and the horizontal width of the notch portion 24 and the groove width perpendicular to them in FIG. 1 can be set to appropriate dimensions so as to be easily hooked on an article to be hooked.

Figure 7:
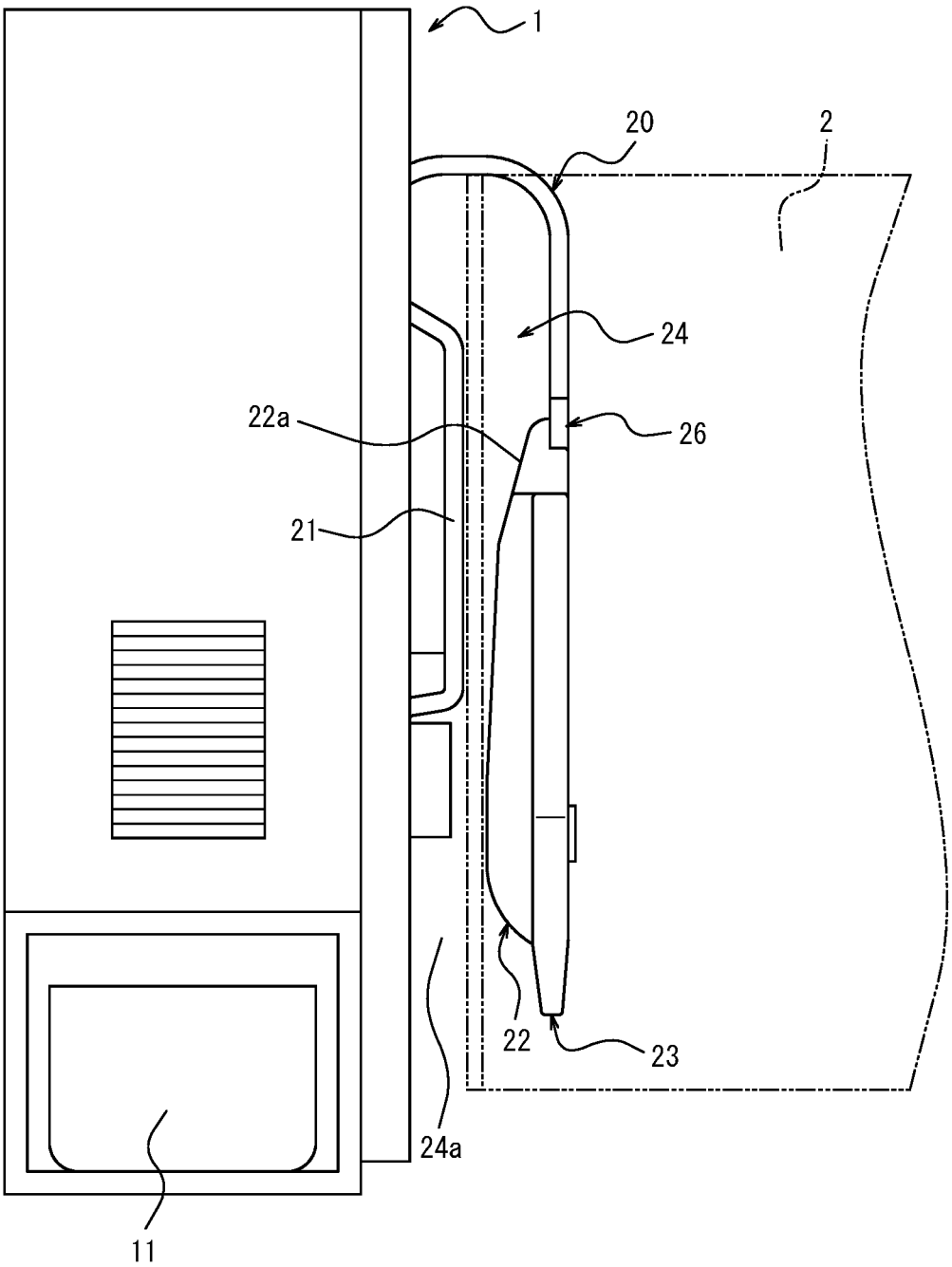
FIG. 7 is a diagram illustrating a state in which the portable tool bracket is hooked on a waist belt to carry the portable tool.

Since the portable tool bracket 20 has the notch portion 24, even if a dedicated holder 30 is not provided, as illustrated in FIG. 7, the user of the portable tool 1 can carry the portable tool 1 by hooking the portable tool bracket 20 on an article to be hooked such as the waist belt 2 at the notch portion 24 so that the portable tool 1 is held by the article to be hooked.

In this manner, the portable tool 1 or the portable tool bracket 20 according to this embodiment is configured to be provided with the notch portion 24 for hooking and holding, in addition to the mounting portion 21 that allows the portable tool bracket 20 to be attached to the portable tool body 10 and the insertion portion 22 that is inserted into the guide rail portion 31 provided on the holder 30 held by a body of a user and is detachably attached to the holder 30. Thus, when a dedicated holder 30 is provided, the insertion portion 22 is attached to the holder 30 and the portable tool 1 is held by the holder 30 to allow for carrying the portable tool 1 while preventing it from falling, and even if a dedicated holder 30 is not provided, the portable tool 1 can be carried by hooking the portable tool bracket 20 on an article to be hooked such as the waist belt 2, or the like.

As illustrated in FIG. 2, it is desirable that the notch portion 24 has: an open end 24*a* on one side (the lower side in FIG. 2) of the center of gravity G (the vertical center of gravity in FIG. 2) of the portable tool body 10 and on the side of the center of gravity G of an end (the lower end in FIG. 2) of the one side of the portable tool body; and an innermost portion 24*b* on the other side (the upper side in FIG. 2) of the center of gravity G of the portable tool body 10.

In this manner, when the portable tool 1 is carried by hooking the portable tool bracket 20 on an article to be hooked such as the waist belt 2, the center of gravity G of the portable tool body 10 is placed so that it is located on the lower side of the innermost portion 24*b* of the notch portion 24 to allow the portable tool 1 to be held more stably by an article to be hooked such as the waist belt 2.

Further, as illustrated in FIG. 2, it is preferable that the notch portion 24 is provided between the mounting portion 21 and the insertion portion 22.

In this manner, the notch portion 24 for hooking the portable tool bracket 20 on an article to be hooked such as the waist belt 2 can be provided without impairing the mountability of the insertion portion 22 to the holder 30.

The portable tool bracket 20 may be configured to be made of at least one or more materials of stainless steel, synthetic resin material, glass fiber reinforced plastic, carbon fiber reinforced plastic and cellulose nanofiber reinforced plastic.

Figure 8:
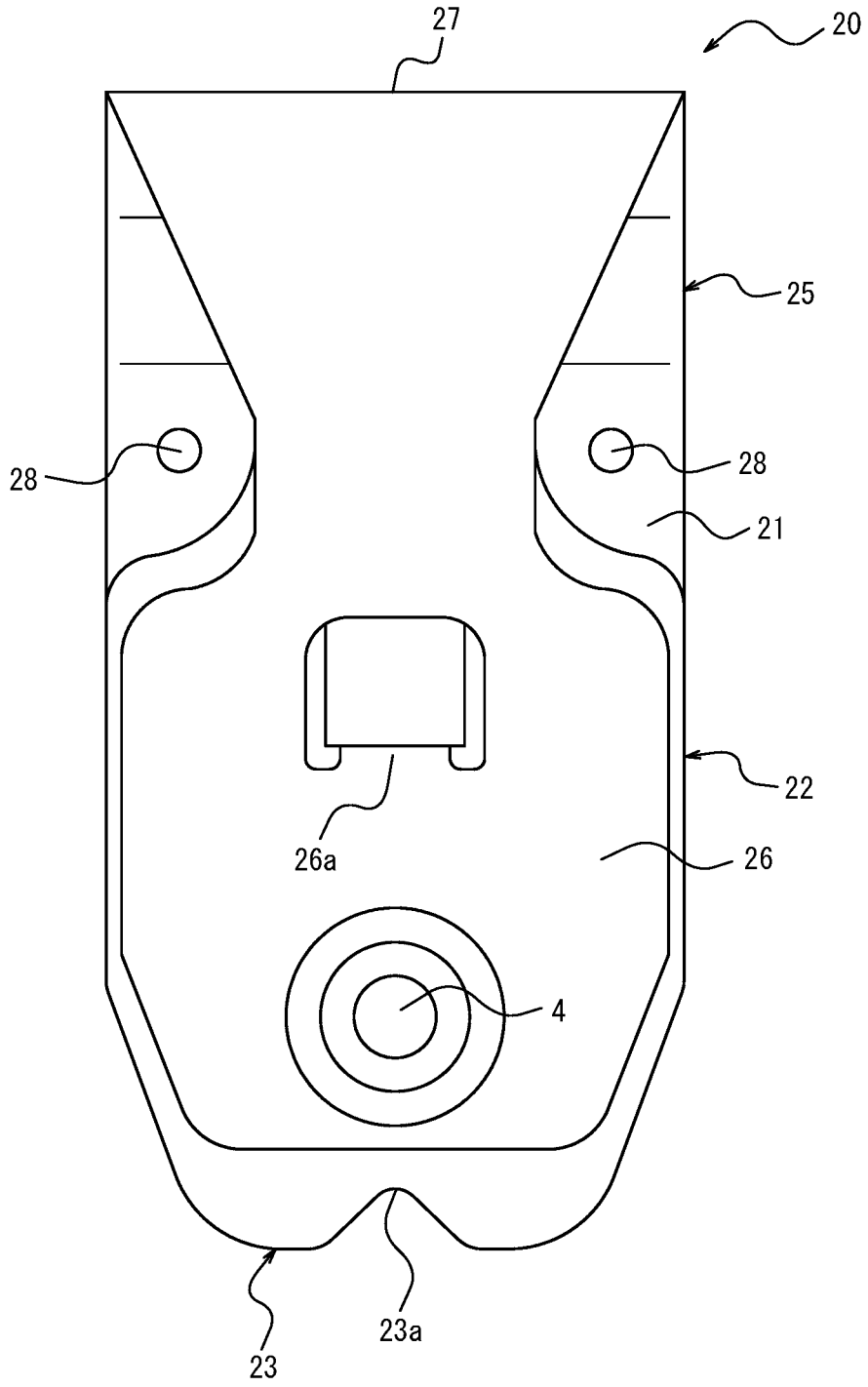
FIG. 8 is a front view of the portable tool bracket illustrated in FIG. 1.
Figure 9:
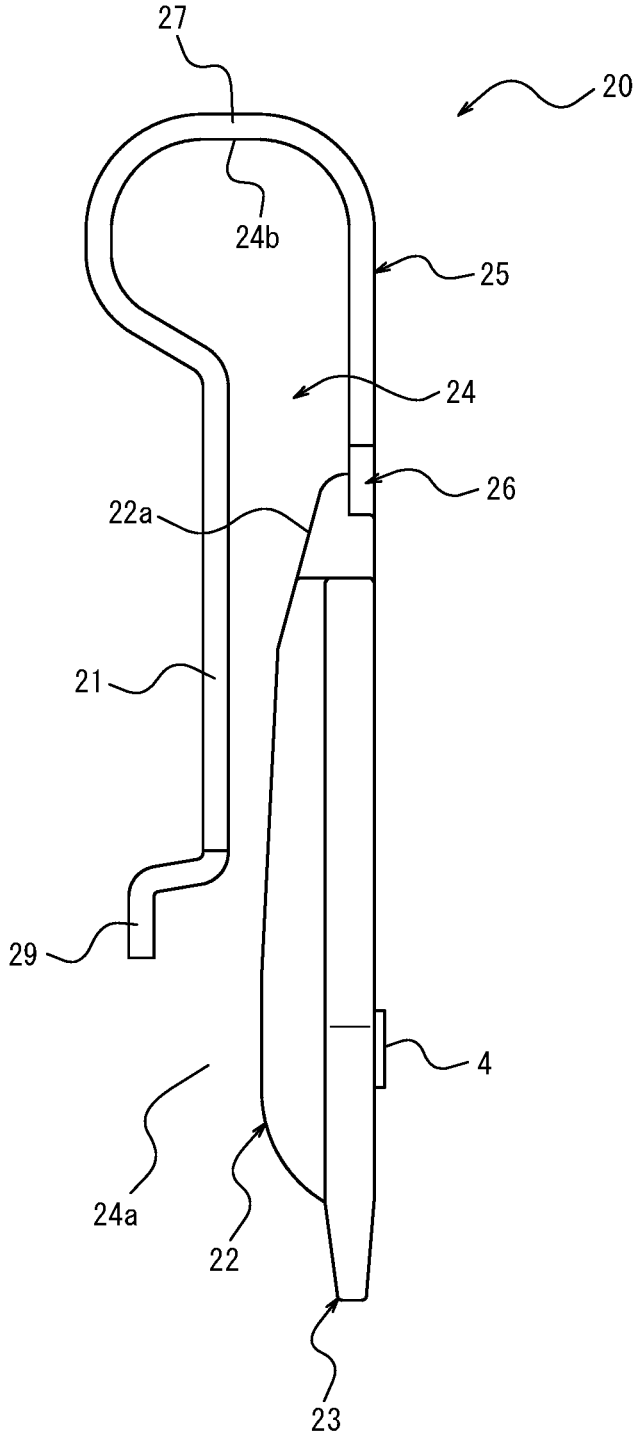
FIG. 9 is a side view of the portable tool bracket illustrated in FIG. 8.
Figure 10:
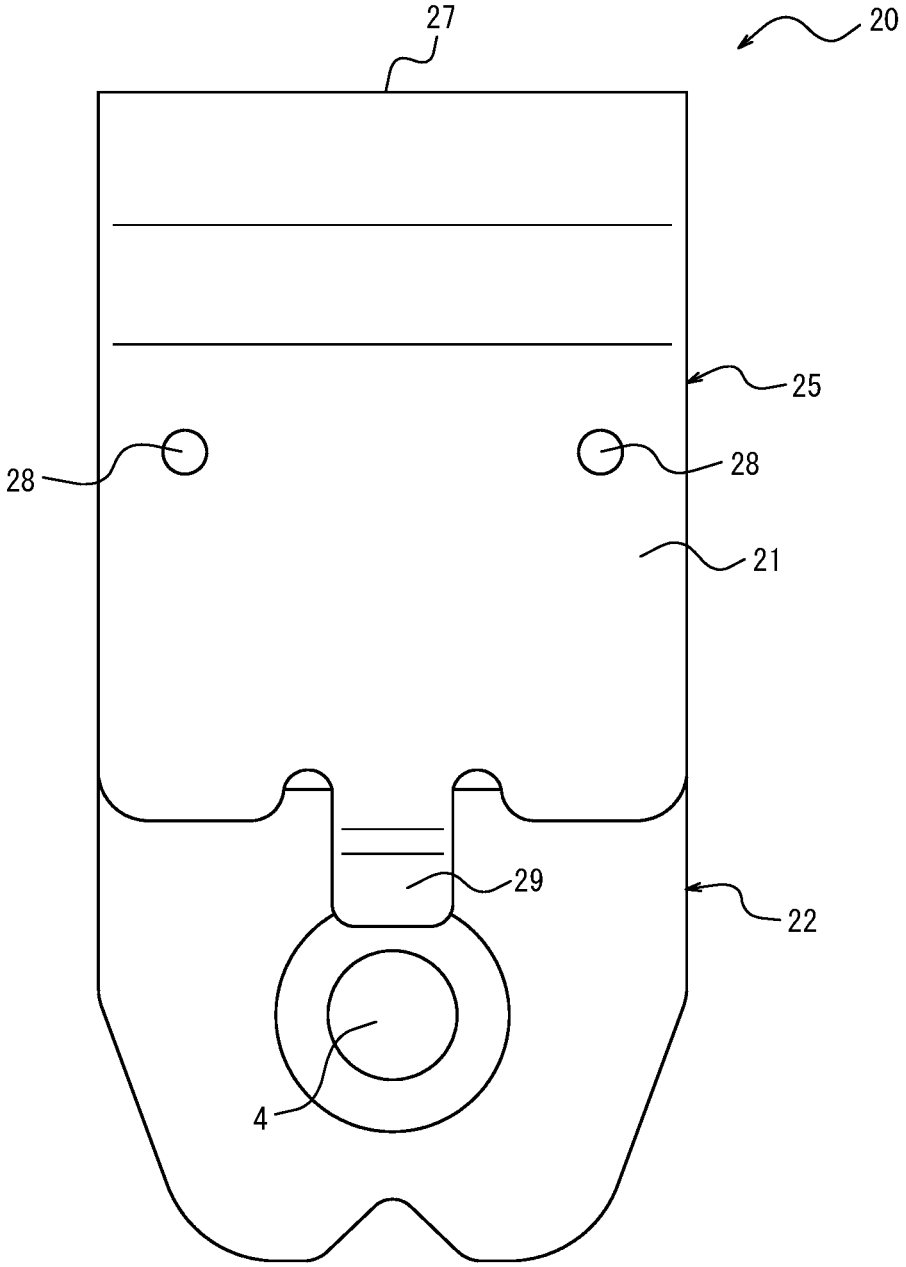
FIG. 10 is a back view of the portable tool bracket illustrated in FIG. 8.

As illustrated in FIGS. 8, 9 and 10, in this embodiment, the portable tool bracket 20 has a configuration in which the insertion portion 22 made of synthetic resin material is fixed to a hook member 25 made of stainless steel.

The material forming the insertion portion 22 is not limited to synthetic resin material, and may be glass fiber reinforced plastic, carbon fiber reinforced plastic, or cellulose nanofiber reinforced plastic.

The hook member 25 is formed by bending a stainless steel plate of a predetermined shape, and a part thereof constitutes a plate-shaped mounting portion 21. Further, the hook member 25 integrally has a plate-shaped hook main body 26 substantially parallel to the mounting portion 21 and a curved portion 27 connecting the mounting portion 21 and the hook main body 26. The curved portion 27 forms the innermost portion 24*b* of the notch portion 24. A predetermined gap is provided between the mounting portion 21 and the hook main body 26, and the gap forms the notch portion 24.

The curved portion 27 has a shape that bulges toward the side opposite to the hook main body 26 with respect to the mounting portion 21, and as illustrated in FIG. 2, is disposed along the shape of the recess of the side wall 12*a* in a state where the portable tool bracket 20 is fixed to the side wall 12*a*.

As illustrated in FIGS. 8 and 10, the mounting portion 21 is provided with a pair of through holes 28 arranged side by side in the width direction at a position biased toward the side of the curved portion 27. Further, the mounting portion 21 is integrally provided with a locking piece 29 that bends stepwise toward the side of the case body 12, at the end on the opposite side to the curved portion 27.

As illustrated in FIGS. 1 and 2, the portable tool bracket 20 is fixed to one of the side walls 12*a* of the case body 12 by inserting the locking piece 29 provided to the mounting portion 21 into a locking hole 12*d* provided in one of the side walls 12*a* of the case body 12 to be locked by the side wall 12*a*, and by screwing a screw member 3 inserted into the pair of through holes 28 provided in the mounting portion 21 into one of the side walls 12*a* of the case body 12.

In this embodiment, the other end side of the mounting portion 21 is fixed to the side wall 12*a* by the screw member 3 while locking one end side of the mounting portion 21 to the side wall 12*a* by the locking piece 29. Thus, compared to the case where one end side of the mounting portion 21 is fixed to the side wall 12*a* by the screw member 3 without providing the locking piece 29, the portable tool bracket 20 can be firmly fixed to the side wall 12*a* while preventing the mounting portion 21 and the curved portion 27 from being damaged.

As illustrated in FIG. 2, the insertion portion 22 is fixed to the inner surface facing the side of the mounting portion 21 on the opening end 24*a* of the hook main body 26. More specifically, the insertion portion 22 engages with a claw portion 26*a* provided to the hook main body 26, and is fixed to the hook main body 26 by using a rivet 4. The insertion portion 22 projects from the inner surface of the hook main body 26 toward the mounting portion 21, and narrows the gap on the side of the opening end 24*a* of the notch portion 24. This allows, when the portable tool bracket 20 is hooked on an article to be hooked such as the waist belt 2, the article to be hooked to be retained by the insertion portion 22 protruding from the hook main body 26, thereby suppressing rattling of the portable tool 1 held by the article to be hooked. Further, the upper end side (the side of the innermost portion 24*b*) of the insertion portion 22 is provided with a slope 22*a* that inclines so that the thickness thereof gradually decreases toward the innermost portion 24*b*. Thus, when the portable tool bracket 20 is hooked on an article to be hooked such as the waist belt 2 at the notch portion 24 and is detached from the article to be hooked, the article to be hooked is prevented from being caught in the insertion portion 22, thereby allowing the portable tool 1 to be detached from the hook more easily.

The surface of the insertion portion 22 facing the side of the mounting portion 21 may be configured to be provided with a non-slip shape such as grooves, protrusions, or emboss processing.

Further, since the portable tool bracket 20 is configured by fixing the insertion portion 22 made of synthetic resin material to the hook member 25 made of stainless steel, wear of the holder 30 into which the insertion portion 22 is inserted can be suppressed while increasing the strength of the portable tool bracket 20.

Furthermore, the hook main body 26 is parallel to the side wall 12*a* in a state where the portable tool bracket 20 is fixed to the side wall 12*a*, which allows for a posture in which the insertion portion 22 extends also parallel to the side wall 12*a*. Thus, when the portable tool 1 is held by the holder 30, the insertion portion 22 of the portable tool bracket 20 can be more easily inserted into the guide rail portion 31 of the holder 30.

The present invention is not limited to the above-described embodiment, and various modifications can be made without departing from the scope of the invention.

Figure 11:
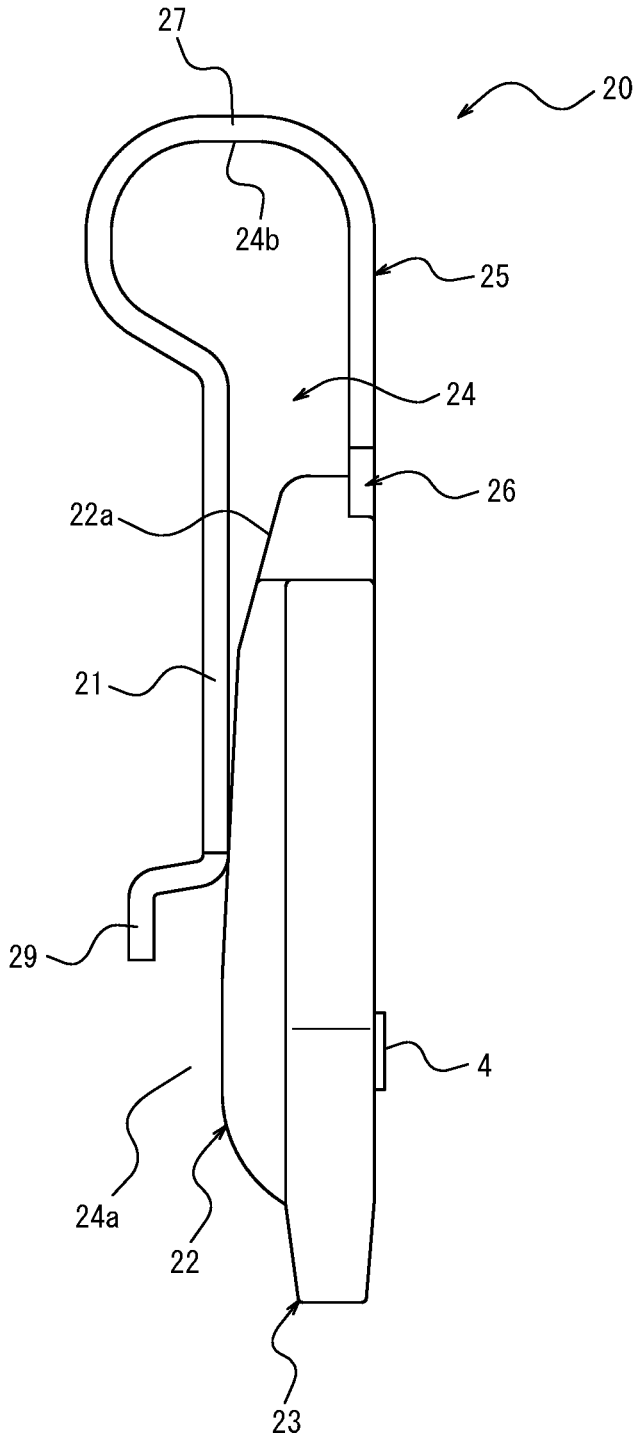
FIG. 11 is a side view of a variation of the portable tool bracket illustrated in FIG. 9.
Figure 12:
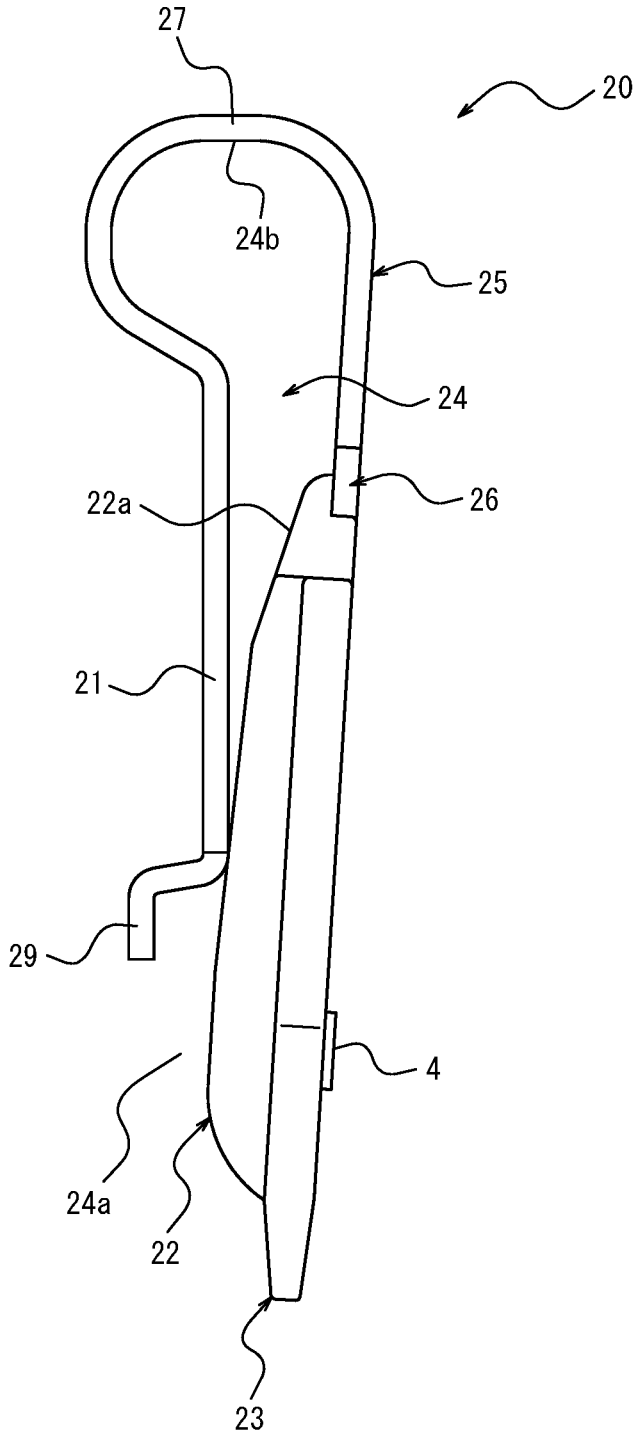
FIG. 12 is a side view of another variation of the portable tool bracket illustrated in FIG. 9.

For example, in the above-described embodiment, as illustrated in FIG. 9, a gap is provided between the insertion portion 22 and the mounting portion 21. However, as illustrated in FIG. 11, for example, the insertion portion 22 may be configured to come into contact with the mounting portion 21 by increasing the thickness of the insertion portion 22 compared to the case illustrated in FIG. 9, or by tilting the hook main body 26 so that it gradually approaches the mounting portion 21 from the side of the curved portion 27 toward the open end 24*a*, as illustrated in FIG. 12. With this configuration, when the portable tool bracket 20 is hooked on an article to be hooked such as the waist belt 2, the article to be hooked is firmly sandwiched between the insertion portion 22 and the mounting portion 21, thereby preventing the portable tool 1 from falling unexpectedly.

Further, in the above-described embodiment, the portable tool bracket 20 is configured by fixing the insertion portion 22 made of synthetic resin material to the hook member 25 made of stainless steel, but the configuration is not limited to this, and the entire portable tool bracket 20 may be formed only by synthetic resin material, or the entire portable tool bracket 20 may be formed by stainless steel. When the entire portable tool bracket 20 is made of synthetic resin material, it may be made of glass fiber reinforced plastic, carbon fiber reinforced plastic or cellulose nanofiber reinforced plastic instead of the synthetic resin material.

Moreover, in the above-described embodiment, although the portable tool bracket 20 is configured by fixing the insertion portion 22, which is molded separately from the hook member 25, to the hook member 25, the insertion portion 22 may be integrally molded with the hook member 25 by injection molding of a synthetic resin material using the hook member 25 as an insert.

Figure 13:
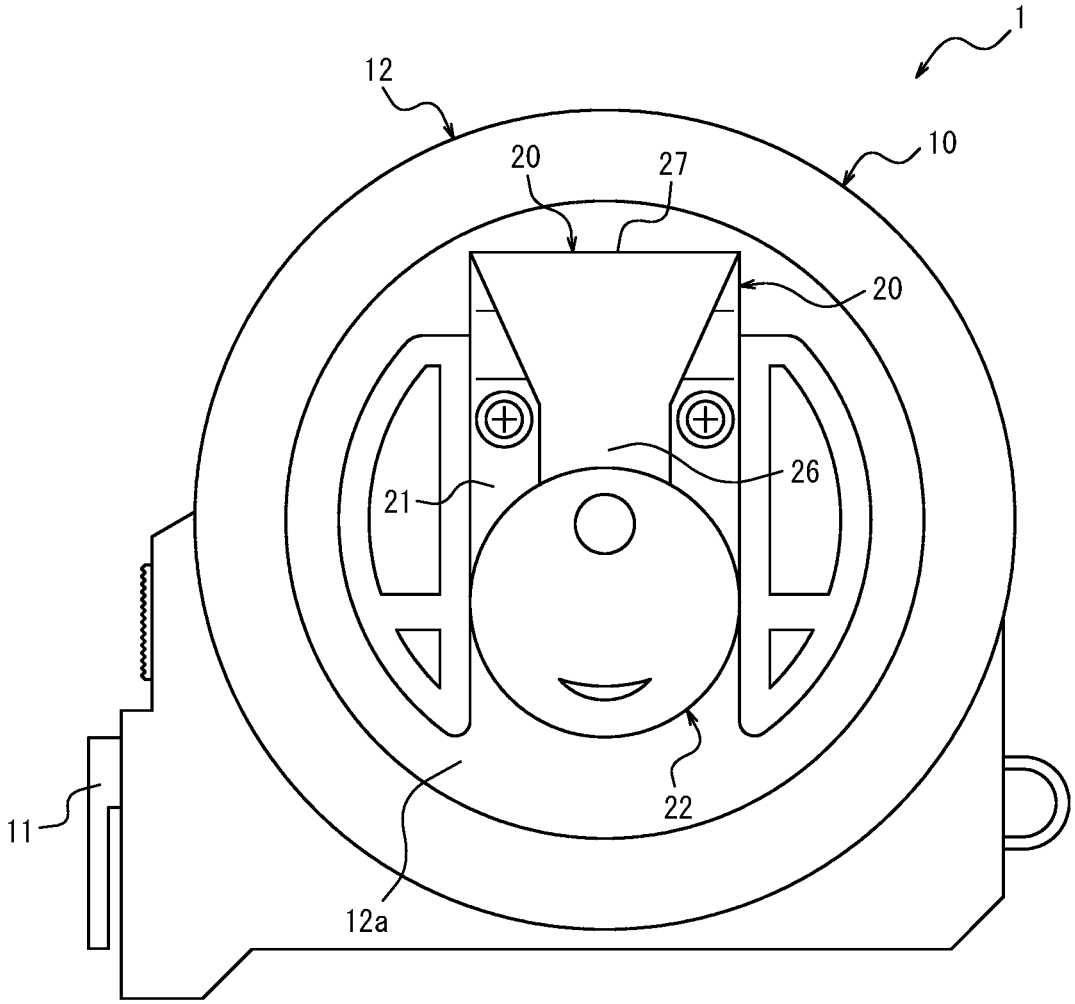
FIG. 13 is a front view of the portable tool to which a portable tool bracket according to the variation is attached.

Furthermore, the portable tool bracket 20 is not limited to the configuration in which the insertion portion 22 is integrally provided with a tapered guide portion 23 at the end side in the insertion direction, and as illustrated in FIG. 13, it may be configured in a circular shape in which the insertion portion 22 is circular, viewed from the front. In this case, the insertion portion 22 is fixed to the outer surface facing the opposite side to the mounting portion 21 of the hook main body 26. This configuration allows the portable tool bracket 20 to be attached to the holder 30 at any angle, which eliminates the need for adjusting the orientation of the portable tool 1 relative to the holder 30 when the portable tool 1 is held by the holder 30, and as a result, the portable tool 1 can be held by the holder 30 more easily.

Moreover, in the above-described embodiment, the mounting portion 21 of the portable tool bracket 20 is attached to the case body 12 of the portable tool body 10 by using the screw member 3, but the configuration is not limited to this, and the mounting portion 21 of the portable tool bracket 20 may be fixed to the case body 12 of the portable tool body 10 by using other means such as adhesive or double sided tape.

Furthermore, in the above-described embodiment, the mounting portion 21 of the portable tool bracket 20 is configured to have a pair of through holes 28, and two pieces of screw member 3 that pass through these through holes 28 are used to attach the mounting portion 21 to the case body 12 of the portable tool body 10, but the configuration is not limited to this, and the mounting portion 21 may be configured to have one or three or more through holes 28, and the mounting portion 21 may be attached to the case body 12 of the portable tool body 10 by using one or three or more screw members 3 that are inserted into these through holes 28.

Moreover, the holder 30 is not limited to be attached to the waist belt 2, and may be attached to a belt provided to, for example, a shoulder belt, a bag, a rucksack, a tool bag, or the like.

The invention claimed is:

1. A portable tool bracket, comprising:

a hook member having a mounting portion attached to a portable tool body and a notch portion for hooking and holding; and an insertion portion that is inserted into a guide rail portion provided on a holder attached to a waist belt and is detachably attached to the holder, wherein the insertion portion has a pair of overhang portions that overhang on both sides of the insertion portion with respect to the hook member, and the notch portion has:

an opening end on one side of a center of gravity of the portable tool body; and an innermost portion on the other side of the center of gravity of the portable tool body.

2. The portable tool bracket according to claim 1, wherein the notch portion is provided between the mounting portion and the insertion portion.

* * * * *